US006991885B2

(12) United States Patent
Ojima et al.

(10) Patent No.: US 6,991,885 B2
(45) Date of Patent: Jan. 31, 2006

(54) NON-MAGNETIC ONE-COMPONENT TONER, NON-MAGNETIC ONE-COMPONENT CONTACT DEVELOPING DEVICE AND IMAGE-FORMING APPARATUS

(75) Inventors: Seishi Ojima, Takatsuki (JP); Hideaki Ueda, Kishiwada (JP)

(73) Assignee: Minolta Co., Ltd., Osaka (JP)

( * ) Notice: Subject to any disclaimer, the term of this patent is extended or adjusted under 35 U.S.C. 154(b) by 113 days.

(21) Appl. No.: 10/607,202

(22) Filed: Jun. 27, 2003

(65) Prior Publication Data

US 2004/0191663 A1 Sep. 30, 2004

(30) Foreign Application Priority Data

Mar. 27, 2003 (JP) ..... 2003-087887

(51) Int. Cl.
*G03G 9/08* (2006.01)

(52) U.S. Cl. ..... 430/110.3; 430/110.4; 430/111.4; 399/265

(58) Field of Classification Search ..... 430/110.3, 430/110.4, 111.4; 399/265
See application file for complete search history.

(56) References Cited

U.S. PATENT DOCUMENTS

| | | | | |
|---|---|---|---|---|
| 4,954,411 | A | 9/1990 | Nishibayashi et al. | |
| 5,915,150 | A * | 6/1999 | Kukimoto et al. | 399/149 |
| 6,077,636 | A | 6/2000 | Moriki et al. | |
| 6,183,924 | B1 | 2/2001 | Nomura et al. | |
| 6,740,460 | B2 * | 5/2004 | Tomita et al. | 430/109.4 |
| 2003/0134220 | A1 * | 7/2003 | Emoto et al. | 430/109.4 |

FOREIGN PATENT DOCUMENTS

| | | | |
|---|---|---|---|
| JP | 5-341567 | A | 12/1993 |
| JP | 11-265120 | * | 3/1998 |
| JP | 11-44964 | A | 2/1999 |
| JP | 11-125931 | | 5/1999 |
| JP | 2002-23483 | | 1/2002 |
| JP | 2002-323783 | A | 11/2002 |
| JP | 2003-84499 | A | 3/2003 |

* cited by examiner

*Primary Examiner*—John L Goodrow
(74) *Attorney, Agent, or Firm*—Buchanan Ingersoll PC

(57) ABSTRACT

The present invention relates to a non-magnetic one-component toner that is characterized by containing toner particles that have a volume-average particle size of 2 to 8 $\mu$m, a ratio of the volume-average particle size/number-average particle size of not more than 1.22, an average degree of roundness of not less than 0.92 and a Vickers hardness of not less than 13.5HV0.01 (10 g), and also concerns a non-magnetic one-component contact developing device using such a toner and an image-forming apparatus using such a developing device.

22 Claims, 2 Drawing Sheets

NON-MAGNETIC ONE-COMPONENT TONER, NON-MAGNETIC ONE-COMPONENT CONTACT DEVELOPING DEVICE AND IMAGE-FORMING APPARATUS

This application is based on application(s) No. 2003-087887 filed in Japan, the contents of which are hereby incorporated by reference.

BACKGROUND OF THE INVENTION

1. Field of the Invention

The invention relates to a non-magnetic one-component toner for use in an electrophotographic system, a non-magnetic one-component contact developing device and an image-forming apparatus.

2. Description of the Related Art

The non-magnetic one-component contact developing system requires no carrier in developer, and consequently makes it possible to simplify the structure of the developing device. This system requires a blade member which controls the toner layer thickness on a toner-supporting member (for example, developing roller), and toner is subjected to a stress between the toner-supporting member and the blade member. Further, since the toner-supporting member is made in contact with an image supporting member (photosensitive member) so that an electrostatic latent image on the image supporting member is developed, the toner is also subjected to a stress between the toner-supporting member and the image supporting member. For this reason, abrasion and toner fusion tend to occur on the blade member and the toner-supporting member. The subsequent problems are deviations in the toner layer thickness and insufficient toner charging, with the result that image irregularities, faded images and fog are caused.

In order to solve the problems of toner fusion to the blade member and toner-supporting member in the non-magnetic one-component developing system, techniques for controlling the particle size distribution of toner, degree of roundness, hardness and the like have been known (see Japanese Patent Application Laid-Open No. Hei11-125931 (claims 1 and 7, on page 2)).

However, the application of the above-mentioned toner has raised a new problem in that there is degradation in the toner transferring efficiency from the surface of the image supporting member to other members such as recording paper. The insufficient transferring efficiency makes it impossible to omit a device for cleaning residual toner on the surface of the image supporting member in an image-forming apparatus, and also makes it incapable of adopting a so-called cleanerless system. Consequently, it is not possible to reduce manufacturing costs of the image-forming apparatus. Furthermore, when the above-mentioned toner is used for a long time in a contact charging system in which a charging member such as a charging brush is made in contact with the image supporting member to charge the surface of the image supporting member, it becomes difficult to carry out the charging process evenly due to residual toner on the surface of the image supporting member, resulting in image irregularities and faded images.

SUMMARY OF THE INVENTION

One objective of the present invention is to provide a non-magnetic one-component toner which can be applied to the non-magnetic one-component contact developing system, and is also applicable to both of a cleanerless system and a contact charging system.

Another objective of the invention is to provide a non-magnetic one-component toner, a developing device and an image-forming apparatus using such a toner, which can provide images that are free from noise such as image irregularities, faded images and fog, for a long time, even when applied to the non-magnetic one-component developing system, the cleanerless system and the contact charging system.

The present invention relates to a non-magnetic one-component toner that is characterized by containing toner particles that have a volume-average particle size of 2 to 8 μm, a ratio of the volume-average particle size/number-average particle size of not more than 1.22, an average degree of roundness of not less than 0.92 and a Vickers hardness of not less than 13.5HV0.01 (10 g), and also concerns a non-magnetic one-component contact developing device using such a toner and an image-forming apparatus using such a developing device.

DESCRIPTION OF THE EMBODIMENTS

Figure 1:
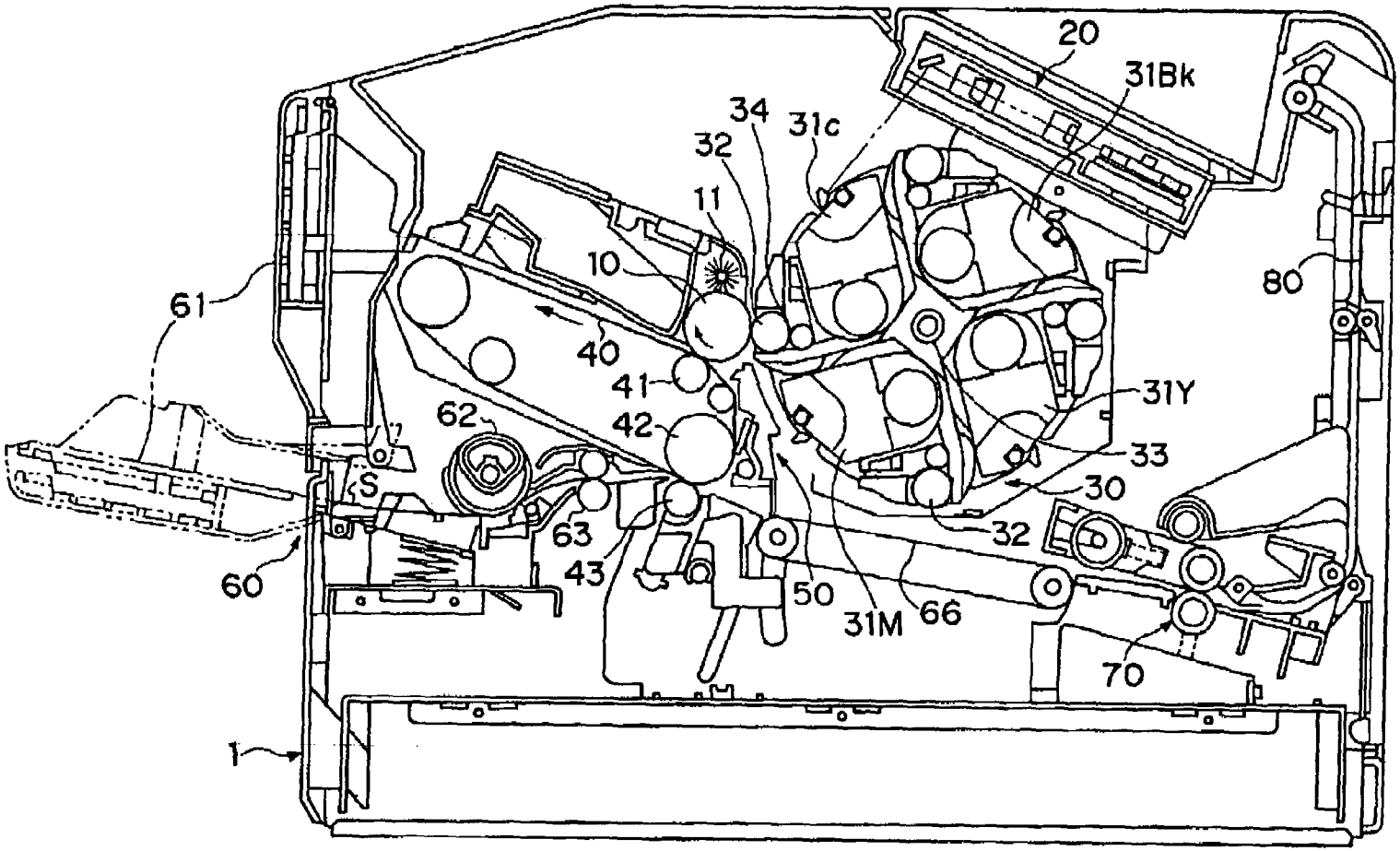
FIG. 1 shows a schematic structural drawing of an image-forming apparatus to which toner of the present invention is applied.

The non-magnetic one-component toner relating to an embodiment of the present invention contains toner particles that have a volume-average particle size of 2 to 8 μm, a ratio of the volume-average particle size/number-average particle size of not more than 1.22, an average degree of roundness of not less than 0.92 and a Vickers hardness of not less than 13.5 HV0.01 (10 g). By simultaneously satisfying these physical-property values, it becomes possible to provide a toner that is suitable for the non-magnetic one-component contact developing system. In other words, when the toner that simultaneously satisfies the above-mentioned physical-property values is applied to a non-magnetic one-component contact developing device, it becomes possible to remarkably improve the transferring efficiency and consequently to provide images that are free from noise such as image irregularities, faded images and fog for a long period of time. Therefore, when this developing device is installed in an image-forming apparatus, the image-forming apparatus is allowed to use a cleanerless system and a contact charging system for the photosensitive member effectively, thereby making it possible to greatly reduce manufacturing costs of the image-forming apparatus. Moreover, the image-forming apparatus, which uses the non-magnetic one-component contact developing system as well as the cleanerless system and contact charging system for the photosensitive member, is allowed to reduce the amount of ozone generation and cause no waste toner, thereby making it possible to achieve an environment-conscious image-forming apparatus. In particular, since the toner particles are set to have a volume average particle size of 2 to 8 μm, it becomes possible to obtain a desirable toner image even in the case of an image-forming apparatus that carries out a high-precision digital exposing process.

When the ratio of volume-average particle size/number-average particle size of the toner particles exceeds 1.22, the toner is susceptible to fusion to the toner-supporting member and the blade member in the developing device due to stress that is exerted between these members, resulting in image irregularities, fog and degradation in the transferring efficiency during endurance printing processes. Moreover, from the viewpoint of effectively preventing the generation of image irregularities during endurance printing processes, the ratio of volume-average particle size/number-average particle size is preferably set to not more than 1.15. The lower limit value of the ratio of volume-average particle size/number-average particle size is not particularly limited; however, from the viewpoint of easiness in the toner manufacturing processes, the ratio is preferably set to, for example, not less than 1.10.

When the average degree of roundness of toner particles is less than 0.92, the transferring efficiency is lowered, resulting in image irregularities. From the viewpoint of effectively preventing the generation of image irregularities during endurance printing processes, the average degree of roundness is preferably set to not less than 0.94. The upper limit value of the average degree of roundness is not particularly limited; however, from the viewpoint of easiness in the toner manufacturing processes, the value is preferably set to not more than 0.98.

When Vickers hardness in the toner particles is less than 13.5HV0.01 (10 g), the toner is susceptible to fusion to the toner-supporting member and the blade member in the developing device due to stress that is exerted between these members, resulting in image irregularities and degradation in the transferring efficiency during endurance printing processes. From the viewpoint of effectively preventing the generation of image irregularities during endurance printing processes, Vickers hardness is preferably set to not less than 15.0HV0.01(10 g). The upper limit value of Vickers hardness is not particularly limited; however, from the viewpoint of easiness in the toner manufacturing processes and appropriate fixing property of the toner particles, it is preferably set to, for example, not more than 17.5HV0.01 (10 g).

In the present specification, with respect to the volume-average particle size and number-average particle size, measured values obtained by a Coulter Multisizer II (made by Coulter Beckman Co., Ltd.) are used. However, the volume-average particle size and number-average particle size are not necessarily measured by this device, and may be measured by any device as long as it can obtain the values based upon the same principle as the device. The closer to 1 the ratio of the volume-average particle size/number-average particle size is set, the narrower the width of the particle size distribution of the toner particles becomes.

The average degree of roundness is the average value of values found by the following equation:

Degree of roundness=(Peripheral length of a circle equal to projection area of a particle)/(Peripheral length of a particle projection image), where "Peripheral length of a circle equal to projection area of a particle" and "Peripheral length of a particle projection image" are represented by values obtained through measurements carried out by using a flow-type particle image analyzer (FPIA-2000; made by Sysmex Corporation) in an aqueous dispersion system. However, the average degree of roundness is not necessarily measured by the above-mentioned apparatus, and any device may be used, as long as it is capable of carrying out the measurements based upon the above-mentioned equation in principle. The closer to 1 the average degree of roundness is set, the closer the shape of the toner particle is set to true globe.

With respect to Vickers hardness, a plate-shaped sample having a thickness of approximately 1 cm, formed by leaving melted toner particles at room temperature to be cooled, is measured by a method in compliance with JISB7725 and JISZ2244, and the resulting values are used.

The toner particles, which constitute the toner of the present embodiment, may be manufactured by using any method, as long as it provides the above-mentioned physical-property values. Preferably, the toner may be manufactured by using a granulation method including an emulsion-polymerizing process in a wet system. With respect to the wet-type granulation method including an emulsion-polymerizing process, methods, such as a so-called emulsion polymerizing method, a soap-free emulsion polymerizing method and an emulsion polymerizing coagulation method, may be used. Among these, in order to easily obtain toner particles that simultaneously satisfy the above-mentioned physical-property values, in particular, the emulsion polymerizing coagulation method is preferably used.

The following description will discuss a case in which the toner particles of the present embodiment are formed by using the emulsion polymerizing coagulation method.

In the emulsion polymerizing coagulation method, first, a polymerizable monomer is emulsion-polymerized to form resin fine particles having a volume-average particle size of 10 to 1,000 nm, particularly 50 to 500 nm. More specifically, a polymerizing composition containing a polymerizable monomer may be dispersed in an aqueous solvent containing a polymerization initiator, and emulsion-polymerized; alternatively, additives such as a release agent and a charge controlling agent are preliminarily dispersed in an aqueous solvent, and a polymerizing composition containing a polymerizable monomer may be dispersed in this aqueous solvent to be subjected to a seed emulsion-polymerizing process. Toner components such as a release agent and a charge controlling agent may be preliminarily added to the polymerizing composition.

Multi-stages of emulsion-polymerizing and seed emulsion-polymerizing processes may be carried out to form resin fine particles. In other words, the polymerizing composition is emulsion-polymerized in an aqueous solvent in the presence of seeds or absence thereof, and the resulting dispersion solution of minute resin fine particles is mixed with an aqueous solvent prepared in a separated manner, and a polymerizing composition, prepared in a separated manner, is further mixed and stirred therein so that a seed emulsion-polymerizing process is carried out. These operations may be carried out repeatedly.

With respect to the polymerizable monomer that forms the polymerizing composition, examples thereof include: styrene-based monomers, such as styrene, methylstyrene, methoxystyrene, ethylstyrene, propylstyrene, butylstyrene, phenylstyrene and chlorostyrene; and alkyl(meth)acrylate-based monomers, such as methyl acrylate, ethyl acrylate, propyl acrylate, butyl acrylate, pentyl acrylate, dodecyl acrylate, stearyl acrylate, ethylhexyl acrylate, lauryl acrylate, methyl methacrylate, ethyl methacrylate, propyl methacrylate, butyl methacrylate, pentyl methacrylate, dodecyl methacrylate, stearyl methacrylate, ethylhexyl methacrylate and lauryl methacrylate. Among these, a styrene-based monomer and an alkyl(meth)acrylate-based monomer are preferably used in combination, or more preferably, styrene and butyl(meth)acrylate are used in combination.

With respect to the polymerizable monomer, a third vinyl compound may be used. With respect to the third vinyl compound, examples thereof include: acidic monomers such as acrylic acid, methacrylic acid, maleic anhydride and vinyl acetate, as well as acrylamide, methacrylamide, acrylonitrile, ethylene, propylene, butylene, vinyl chloride, N-vinyl pyrrolidone, butadiene, etc.

By adjusting the rate of use of the above-mentioned polymerizable monomers, it is possible to control the Vickers hardness of the toner particles.

For example, by adjusting the rate of use of the styrene-based monomer and the alkyl(meth)acrylate-based monomer, the Vickers hardness of the resulting toner particles can be controlled to a desired value. When the rate of use of the styrene-based monomer is increased, the glass transition point of the toner particles becomes higher, resulting in an increase in Vickers hardness. In contrast, when the rate of use of the styrene-based monomer is decreased, the glass transition point of the toner particles becomes lower, resulting in a decrease in Vickers hardness.

Since Vickers hardness also depends on the kinds and amounts of other polymerizable monomer components, the rate of use of the styrene-based monomer and the alkyl (meth)acrylate-based monomer is not simply determined. For example, in the case when in addition to the styrene-based monomer and the alkyl(meth)acrylate-based monomer, any one of the above-mentioned acidic monomers is used approximately at 10 weight % with respect to the total amount of the polymerizable monomer, the rate of use of the styrene-based monomer and the alkyl(meth)acrylate-based monomer is preferably set at 63/27 to 95/5, preferably 67/23 to 90/10. The resin fine particles (toner particles) to be obtained from such a rate of use is normally allowed to have a glass transition temperature of 40° C. to 80° C., particularly 40° C. to 70° C. The rate of use of the third vinyl compound with respect to the entire polymerizable monomer is normally set to not more than 20 weight %, preferably not more than 10 weight %.

In the present invention, a polyfunctional vinyl compound may be used as the polymerizable monomer. With respect to the polyfunctional vinyl compound, examples thereof include: diacrylates of ethylene glycol, propylene glycol, butylene glycol, hexylene glycol and the like, dimethacrylates of ethylene glycol, propylene glycol, butylene glycol, hexylene glycol and the like, divinyl benzene, diacrylates and triacrylates of tertiary or more alcohols such as pentaerythritol and trimethylol propane, and dimethacrylates and trimethacrylates of tertiary or more alcohols such as pentaerythritol and trimethylol propane. The rate of use of the polyfunctional vinyl compound with respect to the entire polymerizable monomer is normally set to 0.001 to 5 weight %, preferably 0.003 to 2 weight %, more preferably, 0.01 to 1 weight %. When the ratio of copolymerization of the polyfunctional vinyl compound is too great, disadvantages, such as poor fixing property and poor transparency in an image on OHP, tend to arise.

A gel component which is insoluble to tetrahydrofran is generated from the copolymerization of the polyfunctional vinyl compound, and the rate of the gel component to the entire polymerized matter is normally set to not more than 40 weight %, preferably not more than 20 weight %.

With respect to the maximum peak molecular weight of the polymer (resin) in the toner particles to be generated by the polymerizing process of the above-mentioned polymerizable monomer, it is normally set to 7,000 to 200,000, preferably 10,000 to 100,000, more preferably 15,000 to 80,000, on a polystyrene equivalent basis by the use of GPC (gel permeation chromatography.). The polymer may have two peaks; however, single peak is more preferable. The peak of the molecular weight distribution may have a shoulder portion, or a tailing portion on the higher molecular-weight side.

A chain transfer agent, which controls the molecular-weight distribution of the polymer upon polymerization, is normally added to the polymerizing composition together with the above-mentioned polymerizable monomer.

With respect to the chain transfer agent, known compounds conventionally used as a chain transfer agent in the field of polymerized toners may be applied. From the viewpoint of easily achieving the above-mentioned Vickers hardness value and alkyl mercaptan, mercapto fatty acid ester and the like are preferably used. Preferably, at least alkyl mercaptan is used.

Alkyl mercaptan is represented by the following formula (I):

$$HS—R^1 \quad (I)$$

In formula (I), $R^1$ represents a monovalent chain hydrocarbon group having from 1 to 20 carbon atoms, preferably 4 to 18 carbon atoms, particularly 7 to 10 carbon atoms, which may have a substituent (for example, an alkoxyl group). Preferable specific examples of alkyl mercaptan include: butyl mercaptan, pentyl mercaptan, hexyl mercaptan, heptyl mercaptan, octyl mercaptan, 2-ethylhexyl mercaptan, decyl mercaptan, dodecyl mercaptan and stearyl mercaptan.

The mercapto fatty acid ester is represented by the following formula (II):

$$(HS—R^2—COO)_n—R^3 \quad (II)$$

In formula (II), $R^2$ represents a chain hydrocarbon group having from 1 to 5 carbon atoms, which may have a substituent, $R^3$ represents a chain hydrocarbon group having from 1 to 18 carbon atoms, which may have a substituent and n indicates an integer of 1 to 4, preferably an integer of 1 or 2. When n is 2 to 4, two to four (HS—$R^2$—COO)— groups may be the same or different.

More specifically, when n is 1, $R^3$ represents a monovalent chain hydrocarbon group having from 1 to 18 carbon atoms, preferably 2 to 12 carbon atoms, which may have a substituent (for example, an alkoxyl group). $R^2$ represents a divalent chain hydrocarbon group having from 1 to 5 carbon atoms, preferably 1 or 2 carbon atoms, which may have a substituent (for example, an alkoxyl group).

In the case when n is 1, preferable specific examples of the mercapto fatty acid ester include: ethyl 2-mercaptopropionate, propyl 2-mercaptopropionate, butyl 2-mercaptopropionate, hexyl 2-mercaptopropionate, ethylhexyl 2-mercaptopropionate, octyl 2-mercaptopropionate, methoxybutyl 2-mercaptopropionate, decyl 2-mercaptopropionate, dodecyl 2-mercaptopropionate, ethyl thioglycolate, propyl thioglycolate, butyl thioglycolate, hexyl thioglycolate, 2-ethylhexyl thioglycolate, octyl thioglycolate, decyl thioglycolate, dodecyl thioglycolate and methoxybutyl thioglycolate.

When n is 2, $R^3$ represents a divalent chain hydrocarbon group having from 1 to 18 carbon atoms, preferably 2 to 4 carbon atoms, which may have a substituent (for example, an alkoxyl group). $R^2$ represents a divalent chain hydrocarbon group having from 1 to 5 carbon atoms, preferably 1 or 2 carbon atoms, which may have a substituent (for example, an alkoxyl group).

In the case when n is 2, preferable specific examples of the mercapto fatty acid ester include: ethylene glycol di(2-mercaptopropionate.), butanediol di(2-mercaptopropionate.), ethylene glycol di(thioglycolate.) and butanediol di(thioglycolate.).

When n is 3, $R^3$ represents a trivalent chain hydrocarbon group having from 1 to 18 carbon atoms, preferably 2 to 4 carbon atoms, which may have a substituent (for example, an alkoxyl group). $R^2$ represents a divalent chain hydrocarbon group having from 1 to 5 carbon atoms, preferably 1 or 2 carbon atoms, which may have a substituent (for example, an alkoxyl group).

In the case when n is 3, preferable specific examples of the mercapto fatty acid ester include: propanetriol tri(2-mercaptopropionate.) and propanetriol tri(thioglycolate).

When n is 4, $R^3$ represents a tetravalent chain hydrocarbon group having from 1 to 18 carbon atoms, preferably 5 carbon atoms, which may have a substituent (for example, an alkoxyl group). $R^2$ represents a divalent chain hydrocarbon group having from 1 to 5 carbon atoms, preferably 1 or 2 carbon atoms, which may have a substituent (for example, an alkoxyl group).

In the case when n is 4, preferable specific examples of the mercapto fatty acid ester include: pentaerythritol tetra(2-mercaptopropionate.) and pentaerythritol tetra(thioglycolate).

With respect to the above-mentioned chain transfer agent, in general, those agents that are commercially available or synthesized materials may be used.

The amount of addition of the chain transfer agent is different depending on desired molecular weights and distributions of the molecular weights. More specifically, it is preferably set in a range of 0.1 to 5 weight %, preferably 0.5 to 3 weight %. In the case when two or more kinds of the chain transfer agents are added, the total amount of addition of these is preferably set in the above-mentioned range.

The aqueous solvent is formed by adding a polymerization initiator to water, and, in general, a dispersion stabilizer is further added to this.

With respect to the polymerization initiator, a water-soluble polymerization initiator is desirably used. Specific examples thereof include: peroxides, such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, peroxy diisopropyl carbonate, tetraphosphor hydroperoxide, 1-phenyl- 2-methylpropyl-1-hydroperoxide, pertriphenyl tert-butyl acetate hydroperoxide, tert-butyl performate, tert-butyl peracetate, tert-butyl perbenzoate, tert-butyl perphenyl acetate, tert-butyl permethoxy acetate, and per N-(3-tolyl) tert-butyl palmitate; and azo compounds such as 2,2'-azobis(2-amidinopropane) hydrochloride, 2,2'-azobis(2-amidinopropane) nitrate, 1,1'-azobis(1-methylbutylonitrile-3-sodium sulfonate), 4,4'-azobis-4-cyanovalerate, poly(bisphenol A-4,4'-azobis-4-cyanopentanoate) and poly(tetraethyleneglycol-2,2'-azobis isobutyrate).

The dispersion stabilizer has a function for preventing dispersed droplets in the aqueous solvent from being integrally joined together. With respect to the dispersion stabilizer, any of known surfactants may be used, and the dispersion stabilizer is appropriately selected from cationic surfactants, anionic surfactants and nonionic surfactants, and used. Two or more kinds of these surfactants may be used in combination.

With respect to the cationic surfactant, specific examples thereof include: dodecyl ammonium chloride, dodecyl ammonium bromide, dodecyl trimethyl ammonium bromide, dodecyl pyridinium chloride, dodecyl pyridinium bromide and hexadecyl trimethyl ammonium bromide.

With respect to the anionic surfactant, specific examples thereof include: fatty acid soap such as sodium stearate and sodium dodecanate, dodecyl sodium sulfate and sodium dodecyl benzene sulfonate.

With respect to the nonionic surfactant, specific examples thereof include: dodecyl polyoxyethylene ether, hexadecyl polyoxyethylene ether, nolylphenylpolyoxyethylene ether, lauryl polyoxyethylene ether, sorbitan monooleate polyoxyethylene ether, styryl phenylpolyoxyethylene ether and monodecanoyl sucrate.

Among these, an anionic surfactant and/or a nonionic surfactant are preferably used.

After forming resin fine particles, toner particles are formed by either the following method (1) or (2):

Method (1): The resin fine particle dispersion solution, obtained through the above-mentioned polymerizing process, is mixed with one or more dispersion solutions in which at least a colorant (a release agent, a charge-control agent, etc., if necessary) has been dispersed, and stirred to cause agglomeration and adhering to each other by applying heat, so that fused particles between the resin fine particles and at least the colorant are formed (agglomerating and adhering processes); thereafter, the entire dispersion system is further heated to fuse the adhered particles to form toner particles (fusing process); or Method (2): The above-mentioned resin fine particle dispersion solution is mixed with a dispersion solution in which at least a colorant has been dispersed, and stirred so as to be agglomerated so that agglomerated particles between the resin fine particles and at least the colorant are formed (agglomerating process); thereafter, the entire dispersion system is heated so that the agglomerated particles are adhered and fused to form toner particles (adhering and fusing processes).

In the present invention, from the viewpoint of easily obtain toner particles having a narrower width of the particle size distribution, method (1) is preferably adopted.

In the present specification, "aggregation" is used as the concept that the resin fine particles and the colorant fine particles are allowed to simply adhere to each other. Although the constituent particles are made in contact with each other through "aggregation", no bonds to be formed through fusing processes between the resin fine particles and the like are formed, with the result that so-called hetero aggregation particles (groups) are formed. Here, such particle groups, formed through "aggregation" are simply referred to as "aggregation particles". Thus, it is possible to control the particle-size distribution of the toner particles by controlling "aggregation".

The term "adhering" is used as the concept that a joint is formed through melting at one portion of an interface between the respective constituent particles in the aggregated particles between the resin fine particles. A group of particles that are subjected to such "adhering" to each other are referred to as "adhered particles".

The term "fusion" is used as the concept that the constituent particles of the adhered particles are integrally joined to each other through melting of the resin fine particles and the like so that a single particle is formed an application and handling unit. A group of particles that are subjected to such a "fusion" are referred to as "fused particles".

In methods (1) and (2), the aggregating in the "aggregating and adhering processes" and "aggregating process" is normally started by adding a flocculating agent in order to stabilize the aggregated particles and to control the particle size distribution of the toner particles.

With respect to the flocculating agent, an ionic surfactant having a polarity different from that of the resin fine particles, a nonionic surfactant and a compound having a monovalent or more charge such as metal salt may be used. Specific examples thereof include: the above-mentioned water-soluble surfactants such as cationic surfactants, anionic surfactants and nonionic surfactants; acids such as hydrochloric acid, sulfuric acid, nitric acid, acetic acid and oxalic acid; metal salts of inorganic acids such as magnesium chloride, calcium chloride, sodium chloride, aluminum chloride, aluminum sulfate, calcium sulfate, aluminum nitrate, silver nitrate, copper sulfate and sodium carbonate; metal salts of fatty acids and aromatic acids such as sodium acetate, potassium formate, sodium oxalate, sodium phthalate and potassium salicylate; metal salts of phenols such as sodium phenolate, metal salts of amino acid, and inorganic acid salts of fatty and aromatic amines such as triethanolamine hydrochloride and aniline hydrochloride. From the viewpoint of stability of coagulated particles, stability of the flocculating agent with respect to heat and time and removal upon washing, metal salts of inorganic acids are preferably used with superior performances and applicability.

The amount of addition of these flocculating agents defers depending on the valence numbers of charge, and in any of the flocculating agents, only the small amount of addition is required. In the case of monovalence, it is set to not more than 3 weight %, in the case of divalence, it is set to not more than 1 weight %, and in the case of trivalence, it is set to approximately not more than 0.5 weight %, with respect to the entire dispersion system. The smaller the amount of addition of the flocculating agent, the more preferable, and compounds having a greater valence number are more preferably used since it becomes possible to reduce the amount of addition.

In general, the aggregation is terminated by stopping the growth of particles through the addition of a stop agent. With respect to the stop agent, a nonionic surfactant, an anionic surfactant and a metal salt of inorganic acid having an antagonism between metal ions, such as sodium salt with magnesium salt of an inorganic acid being added thereto as a flocculating agent, are used. The amount of addition of the stop agent is set to be greater than the above-mentioned amount of addition of the flocculating agent for stabilizing the aggregated particles, and normally set to 2 to 6 weight % in the case when the stop agent is a monovalent metal salt, and to 1 to 3 weight % in the case when the stop agent is a divalent metal salt, with respect to the entire dispersion system.

The heating temperature of "the aggregating and adhering processes" in method (1) is a temperature at which the aggregation and adhering are carried out simultaneously, and normally set to a temperature of not less than the glass transition temperature of the resin fine particles, for example, 60 to 85° C. In contrast, the heating temperature of "the aggregating process" in method (2) is a temperature at which only the aggregation is achieved, and normally set to a temperature of less than the glass transition temperature of the resin fine particles, for example, 25 to 55° C.

In "the fusing process" in method (1), it is necessary to heat the dispersion system to a temperature of not less than the temperature of "the aggregating and adhering processes", and the dispersion system is heated to a temperature in a range from not less than the glass transition temperature to not more than the melting temperature of the resin fine particles, for example, 75 to 110° C., and maintained at this temperature on demand.

In "the adhering and fusing processes" in method (2), it is necessary to heat the dispersion system to a temperature in a range from not less than the glass transition temperature to not more than the melting temperature of the resin fine particles, for example, to the same temperature as the above-mentioned "fusing process", and maintained at this temperature on demand.

It is possible to control the volume-average particle size, the particle size distribution and the average degree of roundness of the toner particles by adjusting the above-mentioned various conditions of the respective processes.

For example, by adjusting the period of time of "the aggregating and adhering processes", it is possible to control the average particle size of the resulting toner particles to a desired value. In other words, when the time is prolonged, the aggregated particles are allowed to grow, making the volume-average particle size greater. In contrast, when the time is shortened, the volume-average particle size becomes smaller.

For example, by adjusting the stirring speed in "the aggregating and adhering processes", it is possible to set the value of volume-average particle size/number-average particle size (particle size distribution.) to a desired value. In other words, the greater the stirring speed, the narrower the width of the particle size distribution becomes, making the above-mentioned value smaller. In contrast, the smaller the stirring speed, the wider the width of the particle size distribution becomes, making the above-mentioned value greater.

For example, by adjusting the holding time and temperature in "the fusing process", it is possible to control the average degree of roundness of the toner particles to a desired value. In other words, when the holding time is prolonged or the temperature is raised, the average degree of roundness becomes greater. In contrast, when the holding time is shortened or the temperature is lowered, the average degree of roundness becomes smaller.

In the preceding stage of "the fusing process" in method (1.), an adhesion process, which adds a fine particle dispersion solution to the adhered particle dispersion solution to be mixed therein so that the fine particles evenly adhere to the surface of the adhered particles to form adhesion particles, is preferably prepared. The adhesion particles are formed through a hetero-aggregation process or the like. With respect to the fine particles to be used in the adhesion process, organic fine particles are used. Specific examples of the organic fine particles include fine particles having a volume-average particle size of not more than 500 nm, preferably 10 to 150 nm, which are made from styrene resin, acrylic resin, polyester resin or the like, and from the viewpoint of manufacturing costs, the same resin fine particles as those used in the aggregating and adhering processes are preferably used.

This adhesion process is preferably carried out by adding a fine particle dispersion solution prior to the addition of the stop agent, and the dispersion system is maintained at the same temperature range as that in "the aggregation and adhering processes" for several hours, particularly 0.5 to 6 hours. By carrying out such an adhesion process, the toner particles can be controlled in the outline shape thereof, thereby it being made possible to easily control the average degree of roundness in the succeeding fusing process. Additionally, the adhesion process does not cause any change in the volume-average particle size and the particle size distribution. After the adhesion process, the adhesion particle dispersion solution is supplied to "the fusing process". Simultaneously with the progress of the formation of the adhesion particles, the fusing process may be carried out.

In the case of method (2), in the succeeding stage of "the aggregating and adhering processes", an adhesion process, which adds a fine particle dispersion solution to the fused particle dispersion solution to be mixed therein so that the fine particles evenly adhere to the surface of the fused particles to form adhesion particles, is preferably prepared. When a color toner is manufactured, the adhesion process is prepared to coat the surface with the resin particles so as to prevent the quantities of charge of the toners of the respective colors from varying due to influences of the pigment. Thus, it is possible to evenly adjust the quantities of change. By coating the surface with a resin different from the resin fine particles used in the "aggregating and adhering processes", it is possible to provide different functions between the toner surface and the inside of the toner. For example, a resin having a low glass transition temperature is used for the inside in order to increase the low-temperature fixing property while a resin having a high glass transition temperature is used for the surface in order to improve the storage stability. With respect to the quantity of charge in the toner, it is possible to provide not only a function for evenly adjusting the quantities of change in the respective color toners, but also a function for compensating for a required quantity of charge by coating the surface with a resin different from the inside resin in the case when the inside resin fails to ensure the required quantity of charge. The adhesion particles are formed by a hetero-aggregating process or the like. With respect to the fine particles to be used in the adhesion process, the same organic fine particles as described above are used. After the adhesion process, the system is heated to a temperature that is not less than the glass transition temperature of the resin fine particles to be fused so that fused particles are formed. Fusing process may be carried out simultaneously with the progress of the formation of the adhesion particles.

With respect to the colorant to be used in the present invention, various organic and inorganic pigments with respective colors, as described below, may be used.

With respect to the black pigment, examples thereof include: carbon black, copper oxide, manganese dioxide, aniline black, activated carbon, non-magnetic ferrite, magnetic ferrite and magnetite.

With respect to the yellow pigment, examples thereof include chrome yellow, zinc yellow, iron oxide yellow, Mineral Fast Yellow, nickel titanium yellow, Navel Yellow, Naphthol Yellow S, Hansa Yellow G, Hansa Yellow 10G, Benzidine Yellow G, Benzidine Yellow GR, Quinoline Yellow Lake, Permanent Yellow NCG and Tartradine Lake.

With respect to the orange pigment, examples thereof include chrome red, molybdenum orange, Permanent Orange GTR, Pyrazolon Orange, Balkan Orange, Indanthrene Brilliant Orange RK, Benzidine Orange G and Indanthrene Brilliant Orange GK.

With respect to the red pigment, examples thereof include iron oxide red, red lead, Permanent Red 4R, Lithol Red, Pyrazolon Red, Watching Red, calcium salt, Lake Red C, Lake Red D, Brilliant Carmine 6B, Eosin Lake, Rhodamine Lake B, Alizarine Lake and Brilliant Carmine 3B.

With respect to the violet pigment, examples thereof include Manganese Violet, Fast Violet B and Methyl Violet Lake.

With respect to the blue pigment, examples thereof include Ultramarine Blue, cobalt blue, Alkali Blue Lake, Victoria Blue Lake, Phthalocyanine Blue, non-metal Phthalocyanine Blue, phthalocyanine blue derivative, Fast Sky Blue and Indanthrene Blue BC.

With respect to the green pigment, examples thereof include Chrome Green, chromium oxide, Pigment Green B, Marakite Green-Lake, Final Yellow Green G and Phthalocyanine Green.

With respect to the white pigment, examples thereof include zinc oxide, titanium oxide, zirconium oxide, aluminum oxide, calcium oxide, calcium carbonate and tin oxide.

With respect to the extender pigment, examples thereof include pearlite powder, barium carbonate, clay, silica, white carbon, talc, alumina white and kaolin.

From the viewpoint of easily manufacturing toner particles, those colorants having a self-dispersing property in water are preferably used. With respect to a treating method for providing the pigment with a self-dispersing property in water, those methods, disclosed in Japanese Patent Application Laid-Open No. 10-120958 (in particular, Example 1), Japanese Patent Application National Publication No. 2000-512670 (in particular, example 1 on page 30) and Japanese Patent Application National Publication No. 2001-511543 (in particular, example 1 on page 21), may be used.

The colorant fine particles may be used alone or a plurality of them may be used in combination. The amount of use of the colorant fine particles is set to 1 to 120 parts by weight, preferably 2 to 100 parts by weight, with respect to 100 parts by weight of the resin fine particles. The amount of the colorant fine particles greater than 120 parts by weight causes degradation in the toner fixing property, and the amount smaller than 1 part by weight fails to provide a desired image density. The colorant is normally used as a dispersion solution in which it is dispersed in water, and the dispersed particle size in the dispersion solution is preferably set in a range of 50 to 500 nm.

The following description will discuss other toner components that may be added to the polymerizing composition, or may be aggregated with resin fine particles in addition to the colorant.

With respect to the release agent, any desired one of known waxes may be used. More specifically, examples thereof include olefin-based wax such as low-molecular weight polyethylene, low-molecular weight polypropylene and copolymer polyethylene; paraffin wax; ester-based wax having a long-chain aliphatic group, such as behenic acid ester, montan acid ester and stearic acid ester; plant-based waxes such as hydrogenated castor oil and carnauba wax; ketones having a long-chain alkyl group such as distearyl ketone; silicone having an alkyl group; higher fatty acid such as stearic acid; (partial) esters between polyhydric alcohol and long-chain aliphatic fatty acid such as long-chain aliphatic alcohol, pentaerythritol and trimethylol propane; and higher fatty acid amides such as oleic acid amide, stearic acid amide and palmitic acid amide.

Each of these release agents is normally used so as to have an amount of 1 to 70 parts by weight, preferably 3 to 80 parts by weight, more preferably 5 to 60 parts by weight, with respect to 100 parts by weight of the resin fine particle component in the resulting toner particles.

With respect to the charge-controlling agent, various substances that provide a positive or negative charge through frictional charging may be used. With respect to the positive charge-controlling agent, examples thereof include Nigrosine dyes such as Nigrosine base ES (made by Orient Chemical Industries, Ltd.); quaternary ammonium salts such as P-51 (made by Orient Chemical Industries, Ltd.) and Copy Charge PX VP435 (made by Clariant Corp.), alkoxylated amine; alkyl amide; chelate molybdate pigment; and imidazole compounds such as PLZ1001 (Shikoku Corp.).

With respect to the negative charge-controlling agent, examples thereof include metal complexes such as Bontron S-22 (made by Orient Chemical Industries, Ltd.), Bontron S-34 (made by Orient Chemical Industries, Ltd.), Bontron E-81 (made by Orient Chemical Industries, Ltd.), Bontron E-84 (made by Orient Chemical Industries, Ltd.) and Spilon Black TRH (made by Hodogaya Chemical Co., Ltd.); thioindigo pigments; calix arene compounds such as Bontron E-89 (made by Orient Chemical Industries, Ltd.); quaternary ammonium salts such as Copy Charge NX VP434 (made by Clariant Corp.); and fluorine compounds such as magnesium fluoride and carbon fluoride. With respect to metal complexes that form a negative charge-controlling agent, in addition to those described above, compounds having various structures, such as metal complexes of oxycarboxylic acid, metal complexes of dicarboxylic acid, metal complexes of amino acid, metal complexes of diketone acid, metal complexes of diamine, metal complexes having an azo-group-containing benzene-benzene derivative skeleton and metal complexes having an azo-group-containing benzene-naphthalene derivative skeleton, may be used.

The charge-controlling agent is preferably designed to have a particle size of approximately 10 to 100 nm, from the viewpoint of uniform dispersion. In the case when the agent that is commercially available has a particle size exceeding the upper limit of the above-mentioned range, the particle size thereof is preferably adjusted by using a known method such as a grinding process by the use of a jet mill or the like.

After the toner particles (fused particles) have been formed, the fine particles are taken out of the dispersion solution, and impurities, mixed therein during the manufacturing processes, are removed through a washing process, and the resulting particles are dried.

In the washing process, acidic water, or basic water depending on cases, is added to the fine particles with the amount of addition being set to several times the amount of the fine particles, and the mixture is stirred, and then filtered to obtain a solid matter. Pure water is added to the solid matter with the amount of addition being set to several times the amount thereof, and the resulting mixture is stirred, and then filtered. These processes are carried out a plurality of times, and stopped when the filtered solution after the filtration has reached a pH of approximately 7. Thus, toner particles are obtained.

In the drying process, the toner particles, obtained through the washing process, are dried at a temperature of not more than the glass transition temperature thereof. At this time, methods in which dried air is circulated in accordance with a required temperature or a heating process is carried out under a vacuum state, may be used. In the drying process, any desired method may be selected from the normal methods such as a vibration-type fluidized drying method, a spray drying method, a freeze-drying method, a flash jet method and the like.

In the present embodiment, the toner may contain a treatment agent on the surface and inside of the toner particle, in particular, on the surface thereof.

With respect to the treatment agent, for example, a fluidity-enhancing agent such as silica, alumina and titania of fine particles, inorganic fine particles such as magnetite, ferrite, cerium oxide, strontium titanate and conductive titania, a resistance-adjusting agent and a lubricant, such as styrene resin and acrylic resin, may be used. In the case when a post treatment agent having the same charging polarity as that of the toner particles is used, upon application of the contact charging system, it becomes possible to easily prevent the post treatment agent from adhering to the contact charging member, and consequently to effectively reduce the occurrence of image irregularities due to insufficient charging on the surface of the photosensitive member. In general, a voltage having the same polarity as the charging polarity of the toner particles is applied to the contact charging member; therefore, even when the post treatment agent having the same charging polarity as that of the toner particles approaches the contact charging member, the particles thereof and the member electrically repel each other. It is considered that this makes it possible to prevent the post treatment agent from adhering to the contact charging member.

The charging polarity of the toner particles refers to an electrical polarity (negative or positive) of the toner particles that is determined when uncharged toner particles are regulated by a toner regulating member in the developing device. The charging polarity of the post treatment agent refers to an electrical polarity (negative or positive) of the post treatment agent that is determined when uncharged post treatment agent is rubbed by the toner regulating member in the same manner as the toner particles. Therefore, it is not simply determined whether the charging polarity of the toner particles is the same as, or different from the charging polarity of the post treatment agent, since these are varied depending on conditions such as the material of the toner regulating member and the applied voltage. However, in general, the following post treatment agent is preferably used.

When the toner particles are negatively charged, silica or the like, which is easily charged to have a negative polarity, is preferably used as the post treatment agent; and when the toner particles are positively charged, strontium titanate or the like, which is easily charged to have a positive polarity, is preferably used as the post treatment agent.

In particular, the amount of use of the post treatment agent is appropriately selected in accordance with desired performances, and, normally, it is preferably set to 0.05 to 10 parts by weight, preferably 0.1 to 5 parts by weight, with respect to 100 parts by weight of the toner particles.

Figure 2:
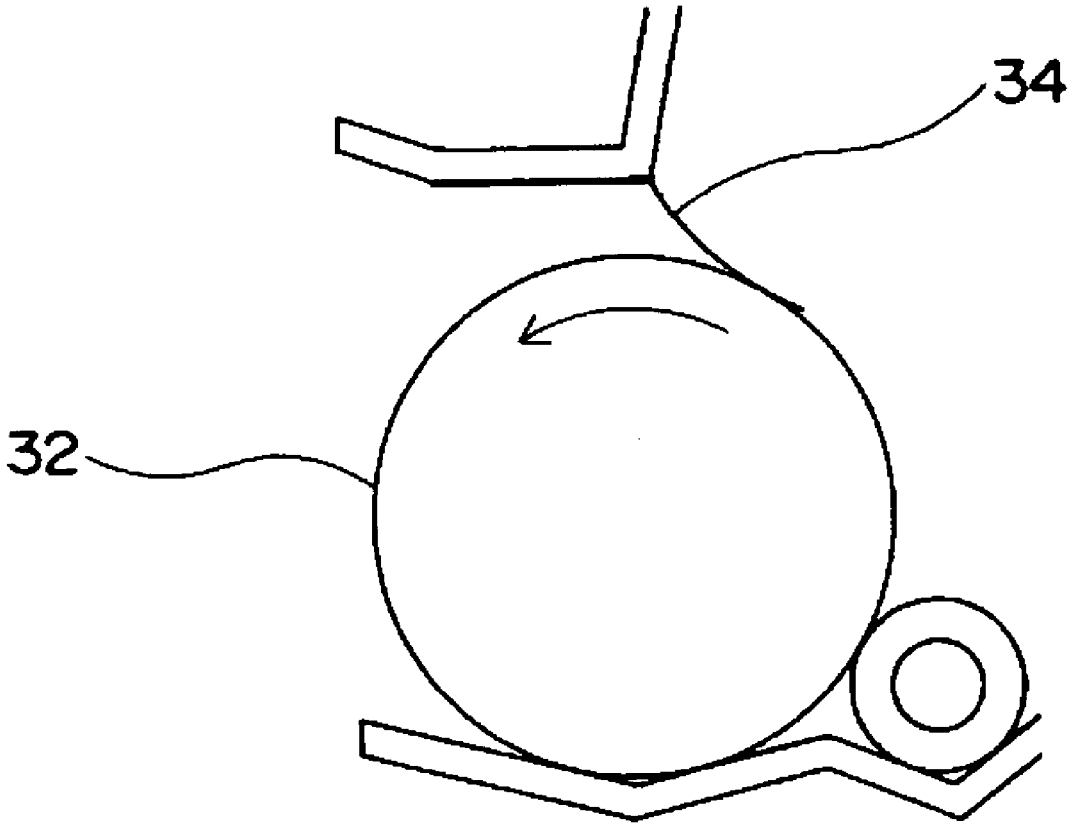
FIG. 2 shows a schematic structural drawing that explains the positional relationship between a developing roller and a toner regulating member in a developing unit in the image-forming apparatus shown in FIG. 1.

Referring to FIGS. 1 and 2, the following description will discuss an image-forming apparatus and a developing device that are specific embodiments of the present invention. The above-mentioned non-magnetic one-component toner of the present invention is desirably applied to the image-forming apparatus and the developing apparatus shown in FIGS. 1 and 2. The image-forming apparatus and the developing device of the present invention are not necessarily limited to those having the following structures as long as they have structures to which non-magnetic one-component toner is desirably applied. In other words, the image-forming apparatus shown in FIG. 1, which is designed to adopt a cleaner-less system, a contact charging system and a contact developing system, may be provided with a cleaning device placed on the periphery of the image supporting member so as to remove residual toner, a charging device for charging the surface of the image supporting member in a non-contact state with the image supporting member, or a developing device for carrying out a developing process in a non-contact state with the image supporting member.

In the full-color image-forming device shown in FIG. 1, on the periphery of an image-bearing device (hereinafter, referred to as a photosensitive drum) 10 that is driven to rotate, a charging brush 11 of a contact charging system, which uniformly charges the surface of the photosensitive drum 10 to a predetermined electrical potential, is installed. The charging member forms a contact charging member which is made in contact with the photosensitive member so as to carry out a charging process. With respect to the charging member, a charging roller provided with a fur brush, a charging roller provided with conductive rubber, or the like may be used.

A laser scanning optical system 20, which scans to expose the photosensitive drum 10 charged by the charging brush 11 with a laser beam, is installed, and based upon printing data having respective cyan, magenta, yellow and black components, which is transferred from a host computer, the scanning and exposing processes are carried out on the photosensitive drum 10 so that electrostatic latent images having the respective colors are successively formed on the photosensitive drum 10.

A full-color developing device 30, which supplies the toners of the respective colors to the photosensitive drum 10 on which the electrostatic latent images are formed so as to carry out full-color developing processes, is provided with developing units 31C, 31M, 31Y and 31Bk of the four colors, which house respective cyan, magenta, yellow and black non-magnetic one-component toners, and are placed on the periphery of a supporting shaft 33. The respective developing units 31C, 31M, 31Y and 31Bk are rotated with the supporting shaft 33 centered on, and set on positions facing the photosensitive drum 10.

In each of the developing units 31C, 31M, 31Y and 31Bk in the full-color developing device 30, as shown in FIG. 2, a toner regulating member 34 is made in press-contact contact with the circumferential surface of a toner-supporting member (developing roller) 32 that rotates to transport toner, and by using this toner regulating member 34, the amount of toner to be transported by the toner-supporting member 32 is controlled and the transported toner is charged. Here, the toner-supporting member 32 is formed as a developing roller made of an elastic roller, and any form is used as long as it has an elastic form; for example, it may be formed into a developing sleeve.

Each time each electrostatic latent image having each color is formed on the photosensitive drum 10 by the laser scanning optical system 20 as described above, this full color developing device 30 is rotated around the supporting shaft 33 as described above so that one of the developing units 31C, 31M, 31Y and 31Bk having the toner with the corresponding color is successively directed to a position facing the photosensitive drum 10. The developing roller 32 in the developing units 31C, 31M, 31Y and 31Bk is made in contact with the photosensitive drum 10 so that the charged toner having each of the colors is successively supplied to the photosensitive drum 10 on which an electrostatic latent image having each of the colors is successively formed so as to carry out a developing process.

An endless intermediate transfer belt 40, which is driven to rotate as an intermediate transfer member 40, is placed at a position on the downstream side in the rotation direction of the photosensitive drum 10 from this full-color developing device 30, and this intermediate transfer belt 40 is driven to rotate in synchronism with the photosensitive drum 10. The intermediate transfer belt 40 is pressed by a rotatable primary transfer roller 41 so as to be made in contact with the photosensitive drum 10. At a portion of a supporting roller 42 for supporting this intermediate transfer belt 40, a secondary transfer roller 43 is placed in a manner so as to rotate. This secondary transfer roller 43 presses a recording material S such as recording paper onto the intermediate transfer belt 40.

In a space between the above-mentioned full-color developing device 30 and the intermediate transfer belt 40, a cleaner 50, which scrapes residual toner from the intermediate transfer belt 40, is placed in a manner so as to removably contact the intermediate transfer belt 40.

A paper-feed means 60, which directs recording materials S such as recording paper to the intermediate transfer belt 40, is constituted by a paper-feed tray 61 that houses the recording materials S, a paper-feed roller 62 which feeds the recording materials S housed in the paper-feed tray 61 sheet by sheet, and a timing roller 63 which transports the recording material S that has been fed in synchronism with an image formed on the above-mentioned intermediate transfer belt 40 to a gap between the intermediate transfer belt 40 and the secondary transfer roller 43. The recording material S, which has been transported to the gap between the intermediate transfer belt 40 and the secondary transfer roller 43, is pressed onto the intermediate transfer belt 40 by the secondary transfer roller 43 so that the toner image is pressed and transferred from the intermediate transfer belt 40 onto the recording material S.

The recording material S on which the toner image has been pressed and transferred as described above is directed to a fixing device 70 by a transporting means 66 constituted by an air suction belt or the like so that the transferred toner image is fixed on the recording material S in this fixing device 70. Thereafter, the recording material S is discharged onto the upper face of the apparatus main body 1 through a vertical transport path 80.

The following description will discuss operations in which a full-color image forming process is carried out by using this full-color image forming apparatus more specifically.

The photosensitive drum 10 and the intermediate transfer belt 40 are driven to rotate in the respective directions at the same peripheral speed and the photosensitive drum 10 is charged to a predetermined electrical potential by a charging brush 11. Then, a cyan image exposure is applied to the photosensitive drum 10 charged as described above by the above-mentioned laser scanning optical system 20 so that an electrostatic latent image of the cyan image is formed on the photosensitive drum 10. The cyan toner, charged by the toner regulating member 34 as described above, is then supplied to the photosensitive drum 10 from the developing unit 31C housing cyan toner to develop the cyan image. The intermediate transfer belt 40 is pressed onto the photosensitive drum 10 supporting the cyan toner image by the primary transfer roller 41 so that the cyan toner image formed on the photosensitive drum 10 is primarily transferred onto the intermediate transfer belt 40.

After the cyan toner image has been transferred onto the intermediate transfer belt 40, the full-color developing device 30 is rotated around the supporting shaft 33 to direct the developing unit 31M housing magenta toner to a position facing the photosensitive drum 10. In the same manner as the above-mentioned cyan image, a magenta image exposure is applied to the photosensitive drum 10 charged as described above by the above-mentioned laser scanning optical system 20 so that an electrostatic latent image is formed on the photosensitive drum 10. The electrostatic latent image is developed by developing unit 31M housing magenta toner. The developed magenta toner image is primarily transferred from the photosensitive drum 10 to the intermediate transfer belt 40. In the same manner also, exposing, developing and primary transferring processes are carried out with respect to a yellow image and a black image so that cyan, magenta, yellow and black toner images are successively superposed on the intermediate transfer belt 40 to form a full-color toner image.

When the last black toner image is primarily transferred onto the intermediate transfer belt 40, a recording material S is transported between the secondary transfer roller 43 and the intermediate transfer belt 40 by the timing roller 63. The recording material S is pressed onto the intermediate transfer belt 40 by the secondary transfer roller 43 so that the full-color toner image formed on the intermediate transfer belt 40 is secondarily transferred onto the recording member S.

When the full-color toner image has been secondarily transferred onto the recording material S, the recording material S is directed to the fixing device 70 by the above-mentioned transporting means 66 so that the transferred full-color toner image is fixed on the recording material S by the fixing device 70. Thereafter, the recording material S is discharged onto the upper face of the apparatus main body 1 through the vertical transport path 80.

After completion of the transferring process of the toner image onto the intermediate transfer belt, the photosensitive drum 10 is subjected to charging, exposing and developing processes for the next image formation, without cleaning processes by a cleaning blade and the like. Even after the transferring process of the toner image onto the intermediate transfer belt, residual toner on the photosensitive drum is mainly collected by the developing units. In this manner, the cleanerless system is achieved.

The full-color image-forming apparatus shown in FIG. 1 uses a 4 cycle system in which one photosensitive member and four developing devices are installed. It may use a tandem system in which four developing devices are placed in parallel with four photosensitive members.

EXAMPLES

In the following description, "parts" refer to "parts by weight", unless otherwise indicated.

The toner manufacturing method described below is adopted in experimental examples, which will be described later.

(Method for Preparation of Toner)

(Preparation of Resin Fine Particle Dispersion Solution)

To a reaction vessel were loaded 100 parts of distilled water and 0.13 parts of sodium dodecyl sulfate, and were heated to 80° C. while being stirred under nitrogen gas stream and to this was added 27 parts of a 1 weight % potassium persulfate aqueous solution. Next, to this was added a mixed solution formed by adding 0.67 parts of n-octyl mercaptan to 37 parts of a monomer mixed solution composed of styrene, butyl acrylate and methacrylic acid with a weight ratio, which will be described later, in 1.5 hours, and this was further maintained for 2 hours so as to complete the polymerizing process. After the completion of the polymerizing reaction, the contents were cooled to room temperature to obtain a milky white resin fine particle dispersion solution. By changing the compositions of styrene and butyl acrylate in the monomer mixed solution as will be described later, toner particles having different degrees of hardness were prepared.

(Preparation of wax dispersion solution)

Distilled water, carnauba wax (made by CERARICA NODA Co.,Ltd.) and sodium dodecyl benzene sulfonate (Neogen SC: (Neogen SC: made by Daiichi Kogyo Seiyaku Co., Ltd.) were mixed, and emulsified and dispersed by applying high shearing pressure to gove a wax fine particle dispersion solution having 20 weight % of solid component. The particle sizes of the wax fine particles were measured by using a dynamic light scattering particle size distribution analyzer (ELS-800; Otsuka Electronics Co., Ltd.) to give an average particle size of 110 nm.

(Preparation of colorant fine particle dispersion Solution)

A self-dispersing pigment formed by introducing a carboxylic acid group onto the surface of carbon black was dispersed in distilled water as colorant fine particles to give a colorant fine particle dispersion solution having 17 weight % of solid component. The particle sizes of the dispersed carbon black fine particles were measured by using a dynamic light scattering particle size distribution analyzer (ELS-800; Otsuka Electronics Co., Ltd.) to give an average particle size of 103 nm. The carboxylic acid group can be introduced by using methods such as heating in a strong acid and a reaction with a compound having a carboxylic acid group.

(Preparation of toner particles)

To a reaction vessel were loaded 10 parts of a resin fine particle dispersion solution, 5.7 parts of a wax dispersion solution, 10 parts of a colorant fine particle dispersion solution and 100 parts of distilled water, and to this was added a 2N sodium hydroxide aqueous solution, while being stirred so that the pH of the mixed dispersion solution was set to 10.0. Then, after having added 17 parts of 50 weight % magnesium chloride aqueous solution, this was heated to 70° C., while being stirred, and maintained until the particles was grown to a desired average particle size. By controlling the stirring speed at this time, the value (particle size distribution.) of volume-average particle size/number-average particle size was controlled. Next, to this was added 20 parts of the same resin fine particle dispersion solution as described above, and after this had been further maintained for 0.5 to 1.5 hours at 70° C., 50 parts of 20 weight % sodium chloride aqueous solution was added thereto, and this was heated to 92° C., and maintained. Since the average degree of roundness becomes greater as the maintaining time becomes longer, this was maintained at 92° C. until a desired average degree of roundness had been achieved. Thereafter, the contents were cooled to room temperature, and subjected to washing processes, such as filtering of the solution and a re-suspending process of the resulting solid matter to distilled water, several times repeatedly, and dried to obtain toner particles.

(Post Treatment)

Post treatment particles were added to the resulting toner particles, and these were subjected to a post treatment for 1 minute at 1,000 rpm by using a Henschel mixer to give toner.

(Measurements on various properties of toner Particles)

The volume-average particle size and number-average particle size were measured by using a Coulter Multisizer II (made by Coulter Beckman Co., Ltd.).

The average degree of roundness was measured by using an FPIA-2000 (made by Sysmex Corporation).

With respect to the Vickers hardness, plate-shaped members having a thickness of approximately 1 cm, which were formed by fusing toner particles and then cooling the resulting toner particles, were used as measuring samples.

Toner of Example 1

A monomer mixed solution containing styrene, butyl acrylate and methacrylic acid at a ratio of 7:2:1 was used to prepare a resin fine particle dispersion solution (volume average primary particle size 68 nm), and this dispersion solution was used to form toner particles having the following physical properties, so that toner was obtained. The volume-average primary particle size of the resin fine particles was measured by using a dynamic light scattering particle size distribution analyzer (ELS-800; Otsuka Electronics Co., Ltd.)(the same is true for the following description).

Volume-average particle size=4.5 μm,

Volume-average particle size/number-average particle size=1.14

Average degree of roundness=0.95,

Vickers hardness=16.2HV0.01(10 g)

Post treatment agent: 1 part of silica (H-2000; made by Wacker Co., Ltd.) with respect to 100 parts of toner particles Toner of Example 2

A monomer mixed solution containing styrene, butyl acrylate and methacrylic acid at a ratio of 7:2:1 was used to prepare a resin fine particle dispersion solution (volume average primary particle size 68 nm), and this dispersion solution was used to form toner particles having the following physical properties, so that toner was obtained.

Volume-average particle size=7.8 μm,

Volume-average particle size/number-average particle size=1.12

Average degree of roundness=0.97,

Vickers hardness=16.4HV0.01 (10 g)

Post treatment agent: 1 part of silica (H-2000; made by Wacker Co., Ltd.) with respect to 100 parts of toner particles Toner of Example 3

A monomer mixed solution containing styrene, butyl acrylate and methacrylic acid at a ratio of 6.7:2.3:1 was used to prepare a resin fine particle dispersion solution (volume average primary particle size 70 nm), and this dispersion solution was used to form toner particles having the following physical properties, so that toner was obtained.

Volume-average particle size=6.5 μm,

Volume-average particle size/number-average particle size=1.14

Average degree of roundness=0.97,

Vickers hardness=15.4HV0.01 (10 g)

Post treatment agent: 0.5 parts of silica (H-2000; made by Wacker Co., Ltd.) and 1 part of Teflon beads with respect to 100 parts of toner particles Toner of Example 4

A monomer mixed solution containing styrene, butyl acrylate and methacrylic acid at a ratio of 8:1:1 was used to prepare a resin fine particle dispersion solution (volume average primary particle size 58 nm), and this dispersion solution was used to form toner particles having the following physical properties so that toner was obtained.

Volume-average particle size=2.2 μm,

Volume-average particle size/number-average particle size=1.16

Average degree of roundness=0.93,

Vickers hardness=17.0HV0.01 (10 g)

Post treatment agent: 0.5 parts of silica (H-2000; made by Wacker Co., Ltd.) and 0.5 parts of titanium oxide (T-805: Japan Aerosil Inc.) with respect to 100 parts of toner particles Toner of Example 5

A monomer mixed solution containing styrene, butyl acrylate and methacrylic acid at a ratio of 6.5:2.5:1 was used to prepare a resin fine particle dispersion solution (volume average primary particle size 66 nm), and this dispersion solution was used to form toner particles having the following physical properties, so that toner was obtained.

Volume-average particle size=4.3 μm,

Volume-average particle size/number-average particle size=1.13

Average degree of roundness=0.98,

Vickers hardness=14.3HV0.01 (10 g)

Post treatment agent: 1 part of silica (H-2000; made by Wacker Co., Ltd.) with respect to 100 parts of toner particles Toner of Example 6

A monomer mixed solution containing styrene, butyl acrylate and methacrylic acid at a ratio of 7:2:1 was used to prepare a resin fine particle dispersion solution (volume average primary particle size 68 nm), and this dispersion solution was used to form toner particles having the following physical properties so that toner was obtained.

Volume-average particle size=3.8 μm,

Volume-average particle size/number-average particle size=1.20

Average degree of roundness=0.95,

Vickers hardness=16.1HV0.01 (10 g)

Post treatment agent: 1 part of silica (H-2000; made by Wacker Co., Ltd.) with respect to 100 parts of toner particles Toner of Example 7

A monomer mixed solution containing styrene, butyl acrylate and methacrylic acid at a ratio of 7:2:1 was used to prepare a resin fine particle dispersion solution (volume average primary particle size 68 nm), and this dispersion solution was used to form toner particles having the following physical properties, so that toner was obtained.

Volume-average particle size=4.7 μm,

Volume-average particle size/number-average particle size=1.14

Average degree of roundness=0.90,

Vickers hardness=16.0HV0.01 (10 g)

Post treatment agent: 1 part of silica (H-2000; made by Wacker Co., Ltd.) with respect to 100 parts of toner particles Toner of Example 8

A monomer mixed solution containing styrene, butyl acrylate and methacrylic acid at a ratio of 6.1:2.9:1 was used to prepare a resin fine particle dispersion solution (volume average primary particle size 72 nm), and this dispersion solution was used to form toner particles having the following physical properties, so that toner was obtained.

Volume-average particle size=4.5 μm,

Volume-average particle size/number-average particle size=1.14

Average degree of roundness=0.96,

Vickers hardness=12.9HV0.01 (10 g)

Post treatment agent: 1 part of silica (H-2000; made by Wacker Co., Ltd.) with respect to 100 parts of toner particles Toner of Example 9

A monomer mixed solution containing styrene, butyl acrylate and methacrylic acid at a ratio of 6.7:2.3:1 was used to prepare a resin fine particle dispersion solution (volume average primary particle size 70 nm), and this dispersion solution was used to form toner particles having the following physical properties, so that toner was obtained.

Volume-average particle size=4.0 μm,

Volume-average particle size/number-average particle size=1.24

Average degree of roundness=0.95,

Vickers hardness=15.7HV0.01 (10 g)

Post treatment agent: 1 part of silica (H-2000; made by Wacker Co., Ltd.) with respect to 100 parts of toner particles

TABLE 1

| | Particle size | Particle size distribution | Degree of roundness | Vickers hardness | Post treatment | |
|---|---|---|---|---|---|---|
| Example 1 | 4.5 | 1.14 | 0.95 | 16.2 | Silica | — |
| Example 2 | 7.8 | 1.12 | 0.97 | 16.4 | Silica | — |
| Example 3 | 6.5 | 1.14 | 0.97 | 15.4 | Silica | Teflon beads |
| Example 4 | 2.2 | 1.16 | 0.93 | 17.0 | Silica | Titanium oxide |
| Example 5 | 4.3 | 1.13 | 0.98 | 14.3 | Silica | — |
| Example 6 | 3.8 | 1.20 | 0.95 | 16.1 | Silica | — |
| Example 7 | 4.7 | 1.14 | 0.90 | 16.0 | Silica | — |
| Example 8 | 4.5 | 1.14 | 0.96 | 12.9 | Silica | — |
| Example 9 | 4.0 | 1.24 | 0.95 | 15.7 | Silica | — |

(Evalution of toner upon actual application)

An image-forming apparatus, prepared by modifying a printer (magicolor2300DL) made by Minolta QMS Co., Ltd. so as to have the structure as shown in FIG. 1, is used to carry out printing processes of 5,000 copies. This image-forming apparatus is arranged so that, in the above-mentioned printer, a one-component contact developing unit is installed as the developing unit and a charging brush roller that contacts the photosensitive member to carry out a charging process is placed as the charging member, with the cleaning-use blade being removed to give a cleanerless structure. The following image evaluation processes were carried out at the initial stage and the stage after the printing processes of 5,000 copies.

Image Density

The image density at a solid portion was measured by a reflection densitometer.

Image Irregularities, Faded Image

Net point portions were visually observed. None of image irregularities and faded images were observed: ○, these were slightly observed: Δ, and these were observed entirely: ×.

Fog

Evaluation was made by visually observing fog on non-printed portions. No fog occurred: ○, and fog occurred: ×.

Transferring efficiency

After a transferring process, residual toner on the photosensitive member was visually observed. Virtually no residual toner: ○, and residual toner was observed after the transferring process: ×.

(Results of evaluation (see table 2))

With respect to the toners of Examples 1 to 3, any of the properties such as image density, image noise, fog and transferring efficiency were excellent in both of the initial stage and after the printing processes of 5,000 copies.

With respect to the toners of Examples 4 to 6, although image irregularities (roughness) slightly occurred after the printing processes of 5,000 copies, no problems were raised in practical use.

With respect to the toner of Example 7, the transferring efficiency was low, with the result that the charging brush was seriously contaminated by residual toner and image irregularities occurred after the printing processes of 5,000 copies.

With respect to the toner of Example 8, noise causing a plurality of white lines occurred after the printing processes of 5,000 copies. Further, residual toner increased at portions corresponding to this noise. Toner fusion was partially observed on the blade member in the developing unit.

With respect to the toner of Example 9, image irregularities and fog were observed after the printing processes of 5,000 copies. Moreover, there was much residual toner. Since toner fusion occurred on the blade member of the developing unit, the toner fusion caused an uneven toner layer thickness on the developing roller and the insufficient charging.

TABLE 2

| | Initial stage | | | | Stage after printing processes of 5000 copies | | | |
|---|---|---|---|---|---|---|---|---|
| | Image density | Irregularities, faded image | Fog | Transferring efficiency | Image density | Irregularities, faded image | Fog | Transferring efficiency |
| Example 1 | 1.40 | ○ | ○ | ○ | 1.40 | ○ | ○ | ○ |
| Example 2 | 1.41 | ○ | ○ | ○ | 1.41 | ○ | ○ | ○ |
| Example 3 | 1.39 | ○ | ○ | ○ | 1.40 | ○ | ○ | ○ |
| Example 4 | 1.40 | ○ | ○ | ○ | 1.42 | Δ | ○ | ○ |
| Example 5 | 1.40 | ○ | ○ | ○ | 1.40 | Δ | ○ | ○ |
| Example 6 | 1.41 | ○ | ○ | ○ | 1.42 | Δ | ○ | ○ |
| Example 7 | 1.40 | ○ | ○ | X | 1.41 | X | ○ | X |
| Example 8 | 1.41 | ○ | ○ | ○ | 1.42 | X | ○ | X |
| Example 9 | 1.39 | ○ | ○ | ○ | 1.43 | X | X | X |

The application of the non-magnetic one-component developing toner, non-magnetic one-component contact developing device and image-forming apparatus of the present invention makes it possible to enhance the transferring efficiency in the initial and endurance printing stages, and consequently to form an image having sufficient image density without image irregularities, faded images and fog.

What is claimed is:

1. A non-magnetic one-component toner, comprising toner particles that have a volume-average particle size of 2 to 8 μm, a ratio of the volume-average particle size/number-average particle size of not more than 1.22, an average degree of roundness of not less than 0.92 and a Vickers hardness of not less than 13.5HV0.01 (10 g).

2. A non-magnetic one-component toner of claim 1, further comprising a post treatment agent having the same charging polarity as that of the toner particles.

3. A non-magnetic one-component toner of claim 2, an addition of the post treatment agent is 0.05–10 parts by weight on the basis of 100 parts by weight of the toner particles.

4. A non-magnetic one-component toner of claim 1, in which the toner particles are prepared by a wet-type granulation method.

5. A non-magnetic one-component toner of claim 1, in which the toner particles are prepared by an emulsion polymerizing coagulation method.

6. A non-magnetic one-component toner of claim 1, in which the ratio of the volume-average particle size/number-average particle size is 1.15 or less.

7. A non-magnetic one-component toner of claim 1, in which the average degree of roundness is 0.94 or more.

8. A non-magnetic one-component toner of claim 1, in which the Vickers hardness is 15.0HV0.01 (10 g) or more.

9. A non-magnetic one-component contact developing device, comprising:

a toner-supplying unit, which houses a non-magnetic one-component toner, comprising toner particles that have a volume-average particle size of 2 to 8 $\mu$m, a ratio of the volume-average particle size/number-average particle size of not more than 1.22, an average degree of roundness of not less than 0.92 and a Vickers hardness of not less than 13.5HV0.01 (10 g), a toner-supporting member, which is made in contact with an image supporting member so that an electrostatic latent image on the image supporting member is developed, a toner-regulating member, which forms a thin toner layer on the toner-supporting member.

10. A non-magnetic one-component contact developing device of claim 9, in which the toner-supporting member is made in elastic form.

11. A non-magnetic one-component contact developing device of claim 9, in which the toner contains a post treatment agent having the same charging polarity as that of the toner particles.

12. A non-magnetic one-component contact developing device of claim 9, in which the toner particles are prepared by a polymerization method.

13. An image-forming apparatus, comprising:

an image-supporting member, a charger, which uniformly charges the image-supporting member, a latent-image-forming device, which forms electrostatic latent images on the charged image-supporting member, and a developing device, which develops the electrostatic latent images in contact with a non-magnetic one-component toner, the non-magnetic one-component toner comprising toner particles that have a volume-average particle size of 2 to 8 $\mu$m, a ratio of the volume-average particle size/number-average particle size of not more than 1.22, an average degree of roundness of not less than 0.92 and a Vickers hardness of not less than 13.5HV0.01 (10 g).

14. An image-forming apparatus of claim 13, further comprising a transferring device which transfers toner-images to a transferring member, to enable the apparatus to successively charge the image-supporting member by the charging system without a cleaning process for residual toner.

15. An image-forming apparatus of claim 14, in which the charger charges the image-supporting member by a charging member in contact with the image-supporting member.

16. An image-forming apparatus of claim 15, in which the charging member is a charging roller provided with a fur brush.

17. An image-forming apparatus of claim 13, in which the toner contains a post treatment agent having the same charging polarity as that of the toner particles.

18. An image-forming apparatus of claim 13, in which the latent-image-forming device is an exposer.

19. An image-forming apparatus of claim 13 for full color, comprising a plurality of image-supporting members and developing devices corresponding to each basic color.

20. An image-forming apparatus of claim 13, further comprising an intermediate transferring member on which toner formed on the image-supporting member is temporarily transferred.

21. The non-magnetic one-component developing toner of claim 1, comprising an agglomerated mixture of a resin particle and a colorant.

22. The non-magnetic one-component developing toner of claim 21, wherein the resin particle comprises a styrene based monomer and/or an alkyl (meth)acrylate based monomer.

* * * * *